US008002398B2

(12) United States Patent
Pearson et al.

(10) Patent No.: US 8,002,398 B2
(45) Date of Patent: Aug. 23, 2011

(54) INK JET INK CARTRIDGE WITH VENTED WICK

(75) Inventors: Douglas H. Pearson, Rochester, NY (US); Stephen M. Neumann, Rochester, NY (US); Diana C. Petranek, Hilton, NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 12/757,259

(22) Filed: Apr. 9, 2010

(65) Prior Publication Data

US 2010/0192352 A1 Aug. 5, 2010

Related U.S. Application Data

(62) Division of application No. 11/679,925, filed on Feb. 28, 2007, now Pat. No. 7,735,983.

(51) Int. Cl.
*B41J 2/175* (2006.01)

(52) U.S. Cl. ..... 347/86

(58) Field of Classification Search ..... 347/86
See application file for complete search history.

(56) References Cited

U.S. PATENT DOCUMENTS

| | | | | |
|---|---|---|---|---|
| 4,229,115 | A | 10/1980 | Olinsky | |
| 4,588,319 | A | 5/1986 | Niemeyer | |
| 5,182,581 | A | 1/1993 | Kashimura et al. | |
| 5,289,212 | A | 2/1994 | Carlotta | |
| 5,491,501 | A | 2/1996 | Dietl et al. | |
| 5,619,237 | A * | 4/1997 | Inoue et al. | 347/86 |
| 6,254,226 | B1 | 7/2001 | Lengyel et al. | |
| 6,503,015 | B1 | 1/2003 | Bianco, Jr. | |
| 6,951,388 | B2 * | 10/2005 | Sasaki | 347/86 |
| 2002/0071012 | A1 | 6/2002 | Breemes, Sr. et al. | |

OTHER PUBLICATIONS

Eastman Kodak Company U.S. Appl. No. 11/491,884, filed Jul. 24, 2006, entitled: Orientating Apparatus, by Brian J. Cashimere, et al.

* cited by examiner

*Primary Examiner* — Julian D Huffman
*Assistant Examiner* — Tracey McMillion
(74) *Attorney, Agent, or Firm* — Peyton C. Watkins

(57) ABSTRACT

A method for assembling an ink cartridge, the method includes the steps of providing a reservoir body having a fluid discharge port including a rim; inserting a wick in the discharge port; providing an opening that is bounded by the rim; inserting a capillary media into the reservoir body and the capillary media contacts a portion on the wick; affixing a lid to the reservoir body and the lid includes a hole and an air vent; injecting ink into the capillary through the hole in the lid; wherein a vent path is formed extending from the opening, along at least a side of the capillary media and to the air vent in the lid.

9 Claims, 7 Drawing Sheets

INK JET INK CARTRIDGE WITH VENTED WICK

CROSS-REFERENCE TO RELATED APPLICATION

This application is a Divisional of prior U.S. patent application Ser. No. 11/679,925 filed Feb. 28, 2007 now U.S. Pat. No. 7,735,983.

FIELD OF THE INVENTION

Embodiments of the present invention pertain to an ink jet ink cartridge with porous capillary media to provide pressure regulation and a wick to supply ink from the capillary media into a printhead. According to embodiments of the present invention, an opening is provided in the wick in order to form a vent path.

BACKGROUND OF THE INVENTION

Fluid-ejection printing devices, such as ink jet printers, commonly have at least one ink cartridge and a printhead chassis that supports the ink cartridge. The ink cartridge may contain one or more reservoirs that provide ink or some other fluid to a printhead. If the ink cartridge has more than one reservoir, each such reservoir often retains fluid of a different color for multi-color printing. On the other hand, if the ink cartridge has only a single reservoir, typically such reservoir is used to retain black ink for black-and-white printing.

The printhead is formed of a printhead die, which typically is connected directly or indirectly to the chassis. In order to form an image, the printhead die, along with the chassis and the ink cartridge, generally are moved in a lateral direction across a width of a substrate, such as paper, as fluid is ejected from the printhead. After the printhead forms a row-portion of the image along the width of the substrate, the substrate is advanced in a direction perpendicular to the lateral direction along a length of the substrate, so that the printhead can form a subsequent row-portion of the image. This process of advancing the substrate for each row-portion is repeated until a next substrate is needed or the image is completed.

For proper operation of the printhead and ink cartridge assembly, it is necessary to regulate the pressure within the ink cartridge. Pressure changes may occur during shipping or storage due to air pressure changes or temperature changes, for example. Pressure changes may occur during printing due to depletion of ink within the ink cartridge as ink is gradually used up, or due to surges that occur during acceleration and deceleration at the end of a row of printing. If the fluid pressure is too great, ink may be caused to dribble out of fluid-ejecting nozzles of the printhead die, or too much ink may be ejected. If the fluid pressure is too small, the printhead may experience ink starvation, resulting in too little ink being ejected so that white streaks are apparent in the printed image.

One method of providing pressure regulation is to have a porous capillary media within the ink reservoir of the ink cartridge. The capillary media is typically a rectangular shaped piece of foam or felt. Capillary forces tend to keep the ink at a slightly negative pressure, so that ink does not run out of the printhead nozzles, which are typically positioned at a lower height (i.e., closer to the substrate) than the ink reservoir. The ink cartridge contains a fluid discharge port for ink to travel from the ink reservoir to the printhead chassis through a pipe which serves as the fluid reception port on the chassis. In order to facilitate a steady flow of ink as needed during printing, a common configuration is to provide a wick (also known as a scavenger member, or an ink delivery member) at the fluid discharge port. The wick is in contact with the capillary media and has different capillary properties than the capillary media. When the ink cartridge is loaded into the printhead chassis, typically the wick is forced into contact with a filter member at the mouth of the fluid reception port. Once the printhead is primed so that fluid fills the various ink passageways between the capillary media and the nozzles on the printhead die, capillary forces take care of supplying ink as needed for printing.

When an ink reservoir in the ink cartridge runs out of ink, a user is charged with the responsibility of removing the empty ink cartridge from the chassis and replacing it with a full ink cartridge. The task of replacing an ink cartridge must be simple and clean so that ink is not incidentally discharged during such a replacement process. If ink is discharged during such a replacement process, ink could stain the user's hands or clothes, and it also could drip into areas of the printer where it might cause damage.

For example, conventional ink cartridges include a shipping cap that seals the fluid discharge port(s). The shipping cap helps to prevent ink evaporation during long-term storage, as well as ink spillage due to air pressure changes. The ink cartridge is generally also provided with a vent path to help relieve pressure differences during shipping, storage, and printing. However, when these shipping caps are removed by a user when installing the ink cartridge into a printer, a transient reduction in pressure at the fluid discharge port opening is caused. This transient reduction in pressure can force ink out of the fluid discharge port during removal of the cap and can cause staining or damage.

Accordingly, a need in the art exists for a cap removal solution that allows a user to simply and cleanly remove the shipping cap from a new ink cartridge prior to insertion of the ink cartridge into the printhead chassis.

SUMMARY

The above-described problems are addressed and a technical solution is achieved in the art by a printing device ink cartridge, according to various embodiments of the present invention. According to an embodiment, an ink cartridge includes a reservoir configured to retain ink, a body retaining the reservoir, a port in the body, and a wick located in the port. The port is configured to release the ink from the reservoir. According to an embodiment of the present invention, the body includes a first opening, and the wick includes a second opening, such that the first opening and the second opening are communicatively connected to form a vent path or a portion of a vent path. Such a vent path mitigates the transient reduction in pressure caused by a removal of a shipping cap, thereby reducing the likelihood that ink spillage will occur during such removal.

According to various embodiments of the present invention, the first opening may be on a surface of the body configured to face up when the ink cartridge is in an orientation in which it is configured to operate. The surface may include a grooved path from the first opening to an edge of the surface, the grooved path forming a portion of the vent path. Also, the second opening may be a notch. Such a notch may have a rounded or substantially rounded interior surface. The second opening may be in a region of the wick that is not configured to contact a fluid reception port of a chassis configured to retain the ink cartridge. The wick may further include a third opening on an opposite side from the second opening. The wick may be symmetrical or substantially symmetrical.

According to various embodiments of the present invention, the ink cartridge may include a capillary media within the reservoir, the capillary media contacting the wick. A space may exist between a surface of the capillary media and an interior surface of the body, the space forming a portion of the vent path.

BRIEF DESCRIPTION OF THE DRAWINGS

The present invention will be more readily understood from the detailed description of exemplary embodiments presented below considered in conjunction with the attached drawings, of which.

It is to be understood that the attached drawings are for purposes of illustrating the concepts of the invention and may not be to scale.

DETAILED DESCRIPTION

Embodiments of the present invention provide one or more openings or notches in a wick for an ink cartridge, such that at least one opening in the wick is communicatively connected to an opening in the body of the ink cartridge in order to provide a vent path to the opening of the fluid discharge port of the ink cartridge.

Figure 1:
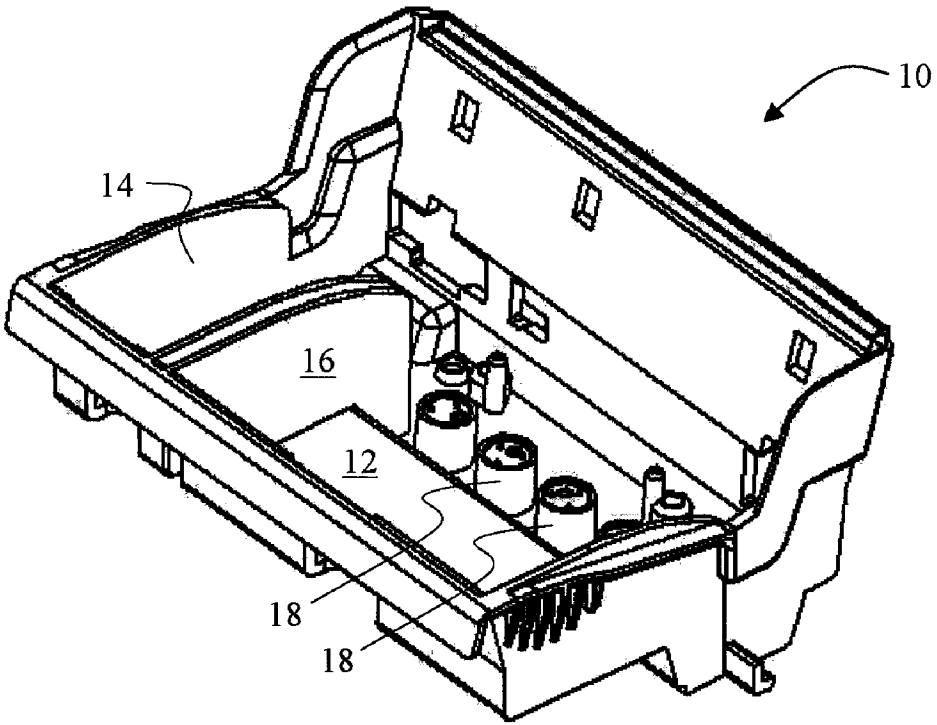
FIG. 1 illustrates a printhead chassis for retaining one or more ink cartridges.

FIG. 1 illustrates a printhead chassis 10. The printhead chassis has a region 12 for a multi-reservoir ink cartridge, and also a region 14 for a single-reservoir ink cartridge. Regions 12 and 14 are separated by one or more partitions 16 which also serve as guides for inserting the ink cartridges into the printhead chassis. In region 12, several fluid reception ports 18 are shown which make connection with the corresponding fluid discharge ports of a multi-reservoir ink cartridge, when the ink cartridge is inserted. Region 14 also has a single fluid reception port (hidden by partition 16) corresponding to the fluid discharge port of a single-reservoir ink cartridge. Not shown in the view of FIG. 1 is the printhead die and its nozzles. Typically, the printhead die would be located underneath the printhead chassis, in a region below the fluid reception ports 18.

Figure 2:
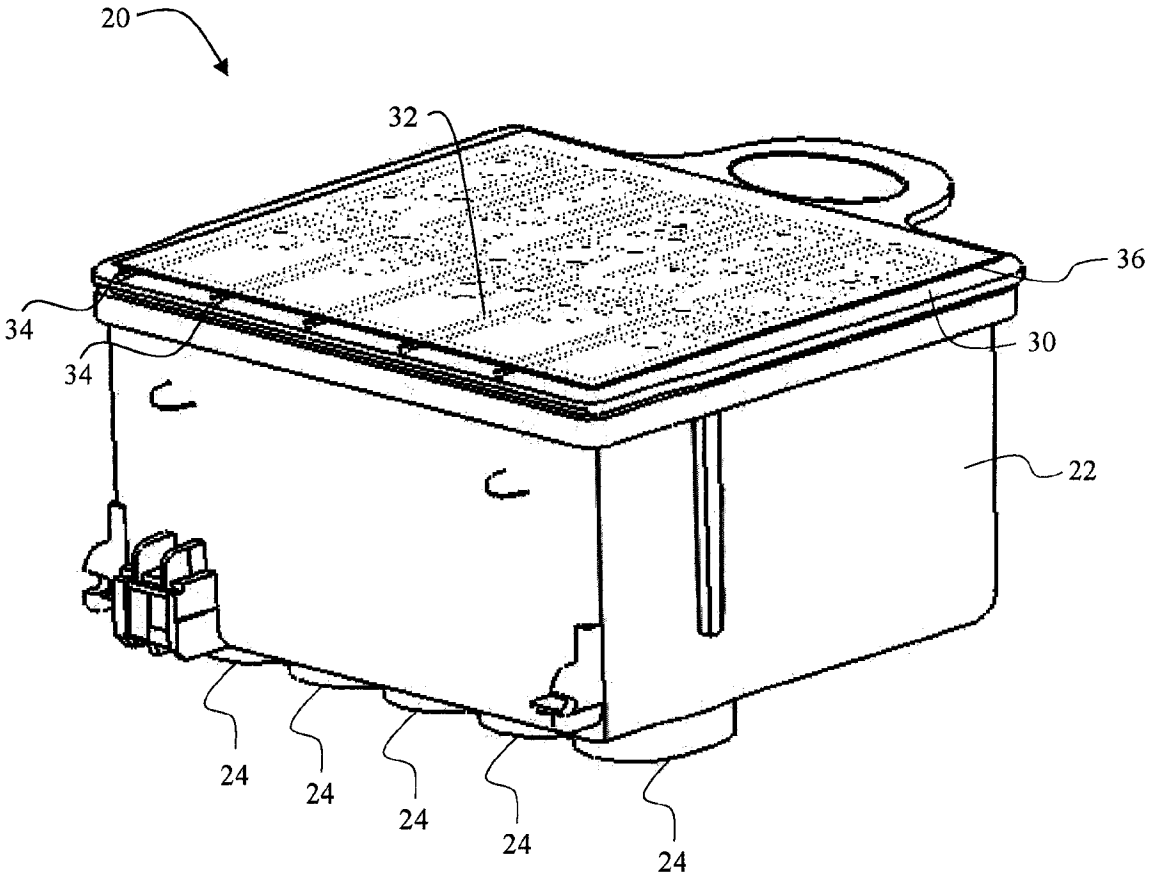
FIG. 2 shows an isometric view of a multi-reservoir ink cartridge.

FIG. 2 shows an isometric view of a multi-reservoir ink cartridge 20 which may be inserted into region 12 of printhead chassis 10. The particular ink cartridge 20 shown in FIG. 2 has five reservoirs within reservoir body 22, each reservoir of which leads to a fluid discharge port 24. The five reservoirs serve as reservoirs intended to hold five fluid sources. The five sources may be, for example, cyan ink, magenta ink, yellow ink, photo black ink, and a protective fluid. Alternatively, they may be cyan ink, light cyan ink, magenta ink, light magenta ink, and yellow ink; or they may be a different combination of fluids.

Ink cartridge 20 is shown as having a lid 30 in the example shown in FIG. 2. Lid 30 is affixed to reservoir body 22. Together, lid 30 and reservoir body 22 make up the ink cartridge body. Typically the lid 30 and the reservoir body 22 are each formed by injection molding. The top surface of lid 30 is formed with grooves in it, as well as one or more holes through the lid, corresponding to the location of each reservoir in the reservoir body. A vent hole (not shown) allows air to pass from the interior of the reservoir to the top of the lid. Each vent hole is intersected by one of the grooved pathways 32 in the lid 30. The grooved pathway 32 may take a circuitous path on the top of the lid 30, but emerges from one edge of the lid. A label 36 is adhered to the top of the lid 30, forming a roof for the grooved pathways 32. Where the grooved pathways 32 emerge from the edge of the lid 30, they form lid vent openings 34 (one lid vent opening per ink reservoir). Since the lid 30 is affixed to reservoir body 22, the lid vent openings 34 each form an opening in the assembled ink cartridge body. Because the lid faces up when the ink cartridge is installed in the printhead chassis in the printer, the lid vent opening 34 is on a surface of the ink cartridge body that faces up when the ink cartridge is in a position in which it is configured to operate.

Figure 3:
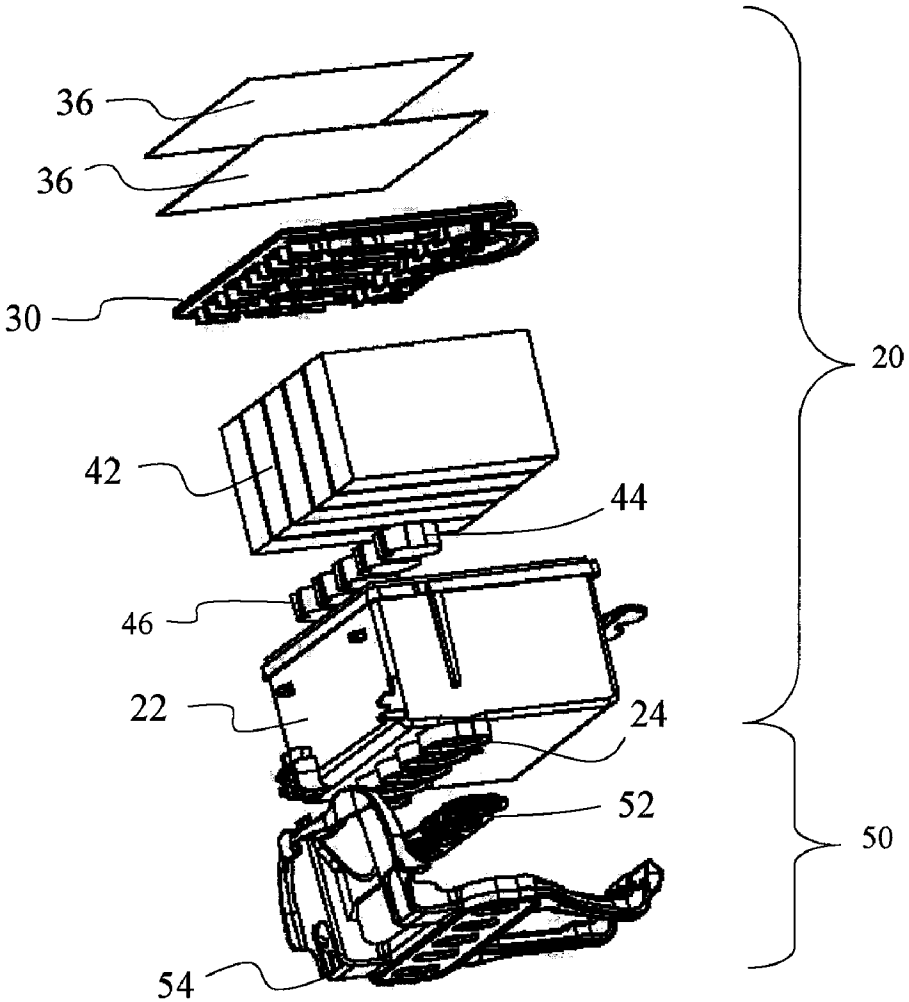
FIG. 3 shows an exploded view of a multi-reservoir ink cartridge, according to an embodiment of the present invention.

FIG. 3 shows an exploded view of multi-reservoir ink cartridge 20 as well as shipping cap seal assembly 50, according to an embodiment of the present invention. Assembly of ink cartridge 20 proceeds substantially as follows: Wicks 44 are inserted into reservoir body 22, with one wick per reservoir, each wick 44 being located at a corresponding fluid discharge port 24. Then capillary media 42 is inserted into reservoir body 22, with one piece of capillary media 42 per reservoir, each capillary media being in contact at its bottom side 43 with the top side of a corresponding wick 44. Then lid 30 is affixed to reservoir body 22 by ultrasonic welding or other means of adhering the lid to the reservoir body. Then ink is injected into the capillary media by inserting one or more needles through holes in lid locations corresponding to each reservoir. Then one or more labels 36 are affixed to the top surface of the lid 30. The lower label 36 has a primary function of sealing the top of the grooved pathway 32 in the top surface of the lid, while the upper label 36 has a primary function of providing information about the ink cartridge.

Figure 4:
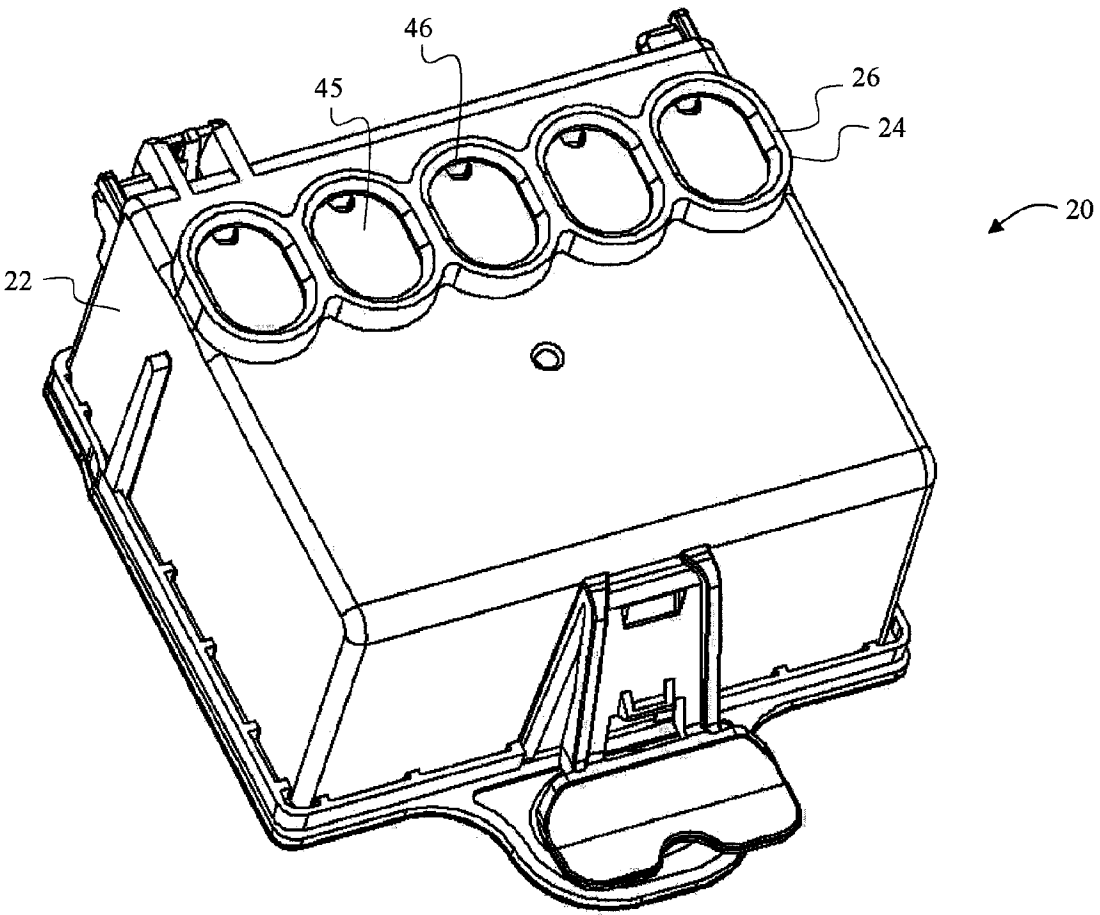
FIG. 4 shows a bottom view of a multi-reservoir ink cartridge, according to an embodiment of the present invention.

FIG. 4 shows a bottom view of multi-reservoir ink cartridge 20 with the bottom surface 45 of each wick 44 visible within each port 24, according to an embodiment of the present invention. Note that the bottom surface 45 of wick 44 is recessed somewhat relative to the outer rim 26 of port 24. Note also wick opening 46 provided in each wick 44. Wick opening 46 is also shown in FIG. 3 and will be discussed below.

When the ink or other fluids have been injected into the respective capillary media 42 in each reservoir, the ink penetrates through the capillary media and also saturates the corresponding wick 44 in the corresponding port 24. Before the ink cartridge 20 is ready to be shipped to the customer, the ports are sealed in order to prevent leakage or excessive evaporation of volatile ink components. Many different styles of seals are possible to be used. For example, a film may be affixed to the outer rim of each port. For this type of seal, the customer may pull a tab at an end of the film and thereby pull the seal away from each port. A second alternative is a twist-off seal, although this type of seal is more compatible with a cartridge having only a single port. With a row of ports 24 as in multi-reservoir ink cartridge 20, the amount of torque to twist off seals from five adjacent reservoirs would be excessively difficult for the user to apply. A third alternative is a seal of the type provided by shipping cap seal assembly 50 shown in FIG. 3. Shipping cap seal assembly 50 includes a compliant seal member 52 which is held in place at the ports 24 by cap seal retainer 54. Compliant seal member 52 is typically is formed using an elastomeric material such as EPDM rubber. Seal retainer 54 is typically formed by injection molding. The sealing member may protrude somewhat into the port, but typically there is still an air space between the bottom surface 45 of wick 44 and the sealing member.

Figure 5:
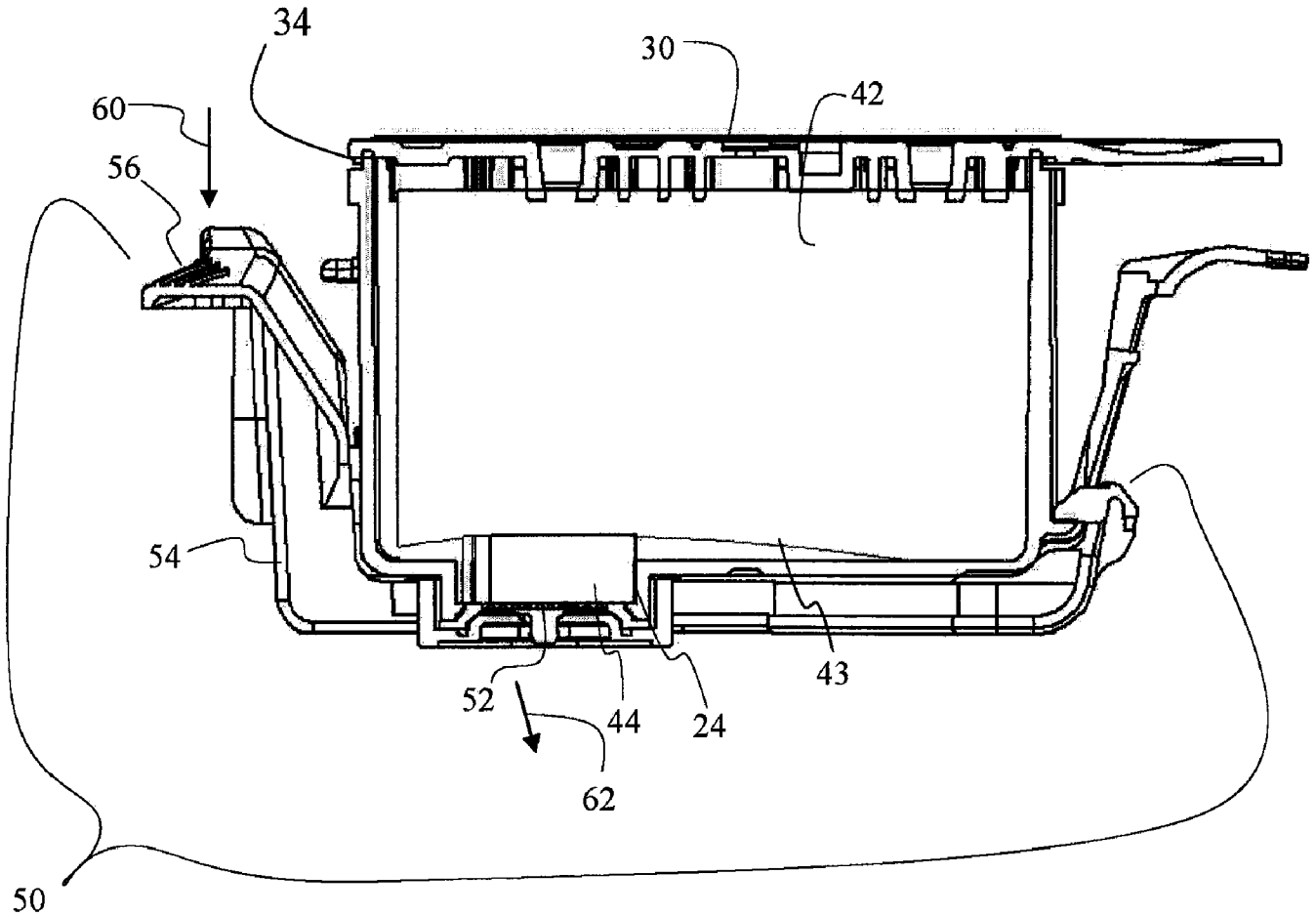
FIG. 5 shows a side view of an ink cartridge with a shipping seal.

FIG. 5 shows a cutaway side view of ink cartridge 20 with shipping cap seal assembly 50 installed in order to prepare it for shipping, according to an embodiment of the present invention. Bottom side 43 of capillary media 42 is shown in contact with the top surface of wick 44. Sealing member 52 is shown pressed against port 24 and held in place by seal retainer 54. In order to remove seal retainer 54, the user presses on seal retainer lever 56 in a downward direction denoted by arrow 60. As a result, the sealing member 52 is pulled away from outer rim 26 of fluid discharge port 24 in a direction denoted by arrow 62.

It is advantageous to unseal a sealing member by moving it away from one end of the outer rim 26 first. However, as the sealing member 52 is pulled away in an angular direction, because of the downward component of sealing member's motion, a momentary air pressure drop is produced in the air space between the bottom surface 45 of wick 44 and the sealing member. This is because the air volume of the air space, which has been at a first equilibrium volume, is increased as the sealing member is pulled away. Since pressure is inversely proportional to volume, as the air volume of the air space increases, its pressure decreases. Since the wick is saturated with ink, unless there is an opening 46 in wick 44, such that opening 46 is part of a vent path to atmosphere, the reduced pressure in the air space (between the bottom 45 of wick 44 and the sealing member 52) will result in ink being forced out of ink cartridge 20 through fluid discharge port 24. If the seal is pulled away suddenly, droplets of ink may splatter out and stain the hands of the user or get onto the printer or other objects. This is true whether the seal is a compliant seal such as sealing member 52, or whether the seal is an adhesively affixed film. Somewhat less susceptible to such volume and pressure changes are the types of seals which may be removed in a twisting motion, since the volume change is very small as the seal is broken. However, as mentioned above, twist-off type seals are not very compatible with multi-reservoir ink cartridges having a row of adjacent ports 24.

Figure 6:
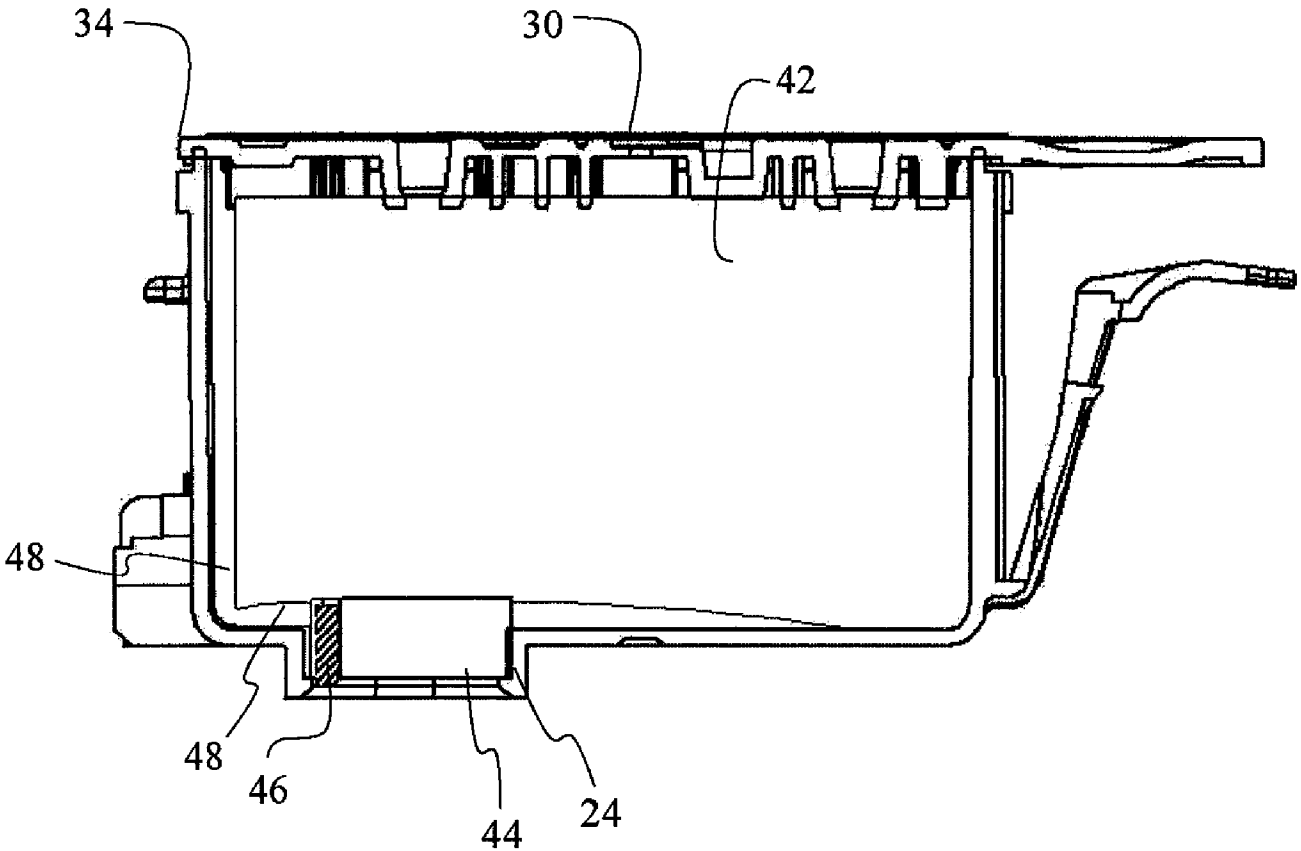
FIG. 6 shows a side view of an ink cartridge, according to an embodiment of the present invention.
Figure 7A:
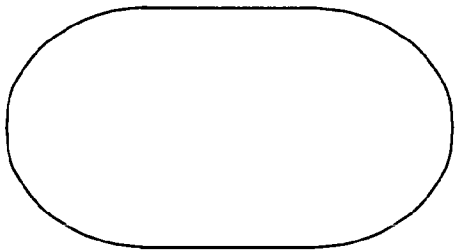
FIG. 7A (PRIOR ART)
FIG. 7A shows a top view of a prior art wick.
Figure 7B:
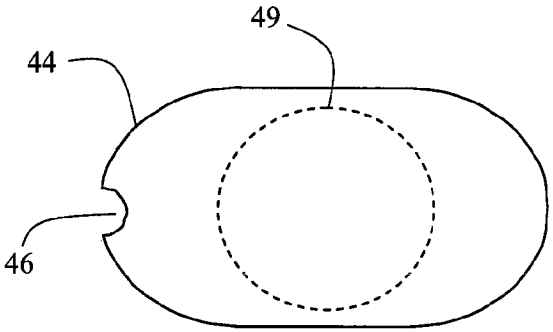
FIGS. 7B through 7D show top views of wicks, according to embodiments of the present invention.
Figure 7C:
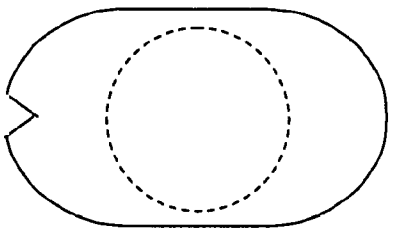
Figure 7D:
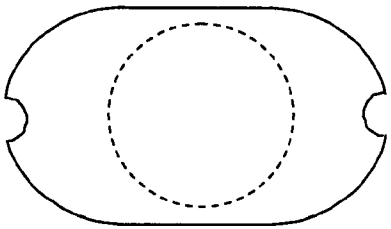

FIG. 6 shows a cutaway side view of an ink cartridge 20 including a wick 44 with a wick opening 46 that forms a part of a vent path 48 between the bottom of wick 44 and atmospheric pressure, according to an embodiment of the present invention. FIG. 6 is similar to FIG. 5, although the sealing cap assembly 50 has been removed for clarity. Also, the wick opening 46 and the vent path 48 between the capillary media 42 and an interior surface of reservoir body 22 are denoted. Vent path 48 extends from lid vent opening 34, along the side, bottom and top of capillary media 42 (the top of capillary media being spaced apart from the lid surface by projections as seen in FIGS. 3 and 5), and from there to wick opening 46 which passes through wick 44. With such a wick opening 46 that forms a portion of a vent path from the bottom surface 45 of wick 44 to atmosphere via lid vent opening 34, removing a sealing member even in a fashion that tends to abruptly increase the air volume in the air space between the bottom of the wick and the sealing member, does not result in a substantial decrease in pressure, because the pressure can be instantly equilibrated with atmospheric pressure. As a result, ink splatters can be substantially eliminated.

FIG. 7 shows top views of several wick configurations. FIG. 7A shows the prior art wick having no wick opening, while FIGS. 7 B-D show embodiments of the present invention. FIG. 7B shows the opening 46 in the form of curved opening, while FIG. 7C shows the opening 46 in the form of a V-shaped notch. Generically we refer to the openings 46 of both FIGS. 7B and 7C as notches. These notches extend from the top surface (shown in FIG. 7 B-D) along the side of wick 44 and to bottom surface 45. Also shown in FIG. 7 B-D is the region 49 of the wick 44 that is configured to contact fluid reception port 18 of printhead chassis 10. Note from FIGS. 1 and 4 that fluid reception port 18 is round, while fluid discharge port 24 (and consequently wick 44) is oval-shaped. Wick opening 46 is provided along an edge of the wick and is not located in the region 49 configured to contact the fluid reception port 18. Note also from FIG. 6 that the location of the wick opening 46 can be important. In the example of FIG. 6, a vent path 48 that leads to lid vent opening 34 (via grooved pathway 32) is provided if wick vent opening 46 is located at the left side of wick 44 when the ink cartridge 20 is oriented in the configuration shown in FIG. 6. Thus, wick orientations similar to FIGS. 7B and 7C would be acceptable, but a wick oriented 180 degrees from those orientations would not provide a continuous vent path. Because assembly of the wicks 44 into their corresponding ports 24 in a single allowable orientation may introduce manufacturing complexities, a wick configuration as shown in FIG. 7D may be advantageous in some applications. In the configuration of FIG. 7D, wick openings 46 are symmetrically disposed at both ends of wick 44. In such a configuration it does not matter whether the wick is rotated or flipped over. A wick opening 46 will still be in an acceptable orientation to provide a vent path.

Although the examples above discuss embodiments in a multi-reservoir cartridge 20, it is to be understood that the same advantages apply to a single reservoir cartridge.

It is to be understood that the exemplary embodiments are merely illustrative of the present invention and that many variations of the above-described embodiments can be devised by one skilled in the art without departing from the scope of the invention. It is therefore intended that all such variations be included within the scope of the following claims and their equivalents.

PARTS LIST

10 Printhead chassis
12 Region for multi-reservoir cartridge
14 Region for single reservoir cartridge
16 Partition
18 Fluid reception port
20 Multi-reservoir ink cartridge
22 Reservoir body
24 Fluid discharge port
26 Outer rim of fluid discharge port
30 Lid
32 Grooved pathway
34 Lid vent opening
36 Label
42 Capillary media
43 Bottom side of capillary media
44 Wick
45 Bottom surface of wick
46 Wick opening
48 Vent path
49 Wick region for contact with fluid reception port
50 Shipping cap seal assembly
52 Seal member

54 Cap seal retainer
56 Seal retainer lever
60 Direction arrow
62 Direction arrow

What is claimed is:

1. A method for assembling an ink cartridge, the method comprising the steps of:

(a) providing a reservoir body having a fluid discharge port including a rim;

(b) inserting a wick in the discharge port (c) providing an opening that is bounded between the rim and the wick;

(d) inserting a capillary media into the reservoir body and the capillary media contacts a portion on the wick;

(e) affixing a lid to the reservoir body and the lid includes a hole and an air vent;

(f) injecting ink into the capillary through the hole in the lid;

wherein a vent path is formed extending from the opening, along at least a side of the capillary media and to the air vent in the lid.

2. The method as in claim 1 further comprising affixing a film to seal the hole in the lid.

3. The method as in claim 2, wherein the air vent is provided by a grooved pathway in a surface of the lid, and wherein affixing the film also seals the grooved pathway.

4. The method as in claim 1, wherein the step of inserting the capillary media further includes forming an air path between the capillary media and the reservoir body that forms a portion of the vent path.

5. The method as in claim 4, wherein the step of inserting the capillary media further includes maintaining the capillary media in a spaced apart relationship with at least a portion of a bottom of the reservoir body.

6. The method as in claim 1 further comprising providing projections in the lid to maintain the capillary media in a spaced apart relationship with at least a portion of the lid.

7. The method as in claim 1 further comprising the step of affixing a sealing member to the discharge port.

8. The method as in claim 7, wherein the step of affixing the sealing member includes adhesively attaching a film to the discharge port.

9. The method as in claim 7, wherein the step of affixing the sealing member includes holding a compliant member against the discharge port.

* * * * *